US005320345A

United States Patent [19]

Lai et al.

[11] Patent Number: 5,320,345

[45] Date of Patent: Jun. 14, 1994

[54] GAME BALL WITH TRANSPARENT COVER

[75] Inventors: Houang-Pin Lai; Charles Lai; Chih-Lung Chang; Mickey Leow, all of Taichung, Taiwan; Gerald Grayer, Country Club Hills, Ill.

[73] Assignee: Wilson Sporting Goods Co., Chicago, Ill.

[21] Appl. No.: 955,106

[22] Filed: Oct. 1, 1992

[51] Int. Cl.[5] ..... A63B 39/06; A63B 41/08

[52] U.S. Cl. ..... 273/58 R; 273/58 A; 273/58 BA; 40/327

[58] Field of Search ..... 40/327; 273/58 R, 58 A, 273/58 B, 58 BA, 65 R, 65 E, 65 ED, 65 EE, DIG. 14, 233, 60 A

[56] References Cited

U.S. PATENT DOCUMENTS

| | | | |
|---|---|---|---|
| 1,542,005 | 6/1925 | Riley | 40/327 |
| 2,301,506 | 11/1942 | Bean | 273/58 K |
| 3,091,562 | 5/1963 | Berlepsch | 273/65 EE |
| 3,879,876 | 4/1975 | Morgan | 40/327 |
| 3,980,300 | 9/1976 | Hornsby | 40/327 |
| 4,234,643 | 11/1980 | Grotefend et al. | 40/327 |
| 4,798,386 | 1/1989 | Berard | 40/327 |
| 4,998,734 | 3/1991 | Meyer | 40/327 |
| 5,040,793 | 8/1991 | Chen | 40/327 |
| 5,102,131 | 4/1992 | Remington | 273/58 G |

FOREIGN PATENT DOCUMENTS

| | | | |
|---|---|---|---|
| 636933 | 2/1962 | Canada | 40/327 |
| 636942 | 2/1962 | Canada | 40/327 |

*Primary Examiner*—Vincent Millin
*Assistant Examiner*—Steven B. Wong

[57] ABSTRACT

A game ball includes an inflatable bladder or a core and a transparent cover over the bladder or core. The bladder or core may include a layer of windings, and the bladder or core is visible through the transparent cover to provide an unusual visual appearance. An inner label can be positioned between the bladder or core and the cover. The label is visible through the transparent cover, but the label is protected from abrasion and wear by the cover. An outer label may be applied to the outer surface of the cover.

9 Claims, 3 Drawing Sheets

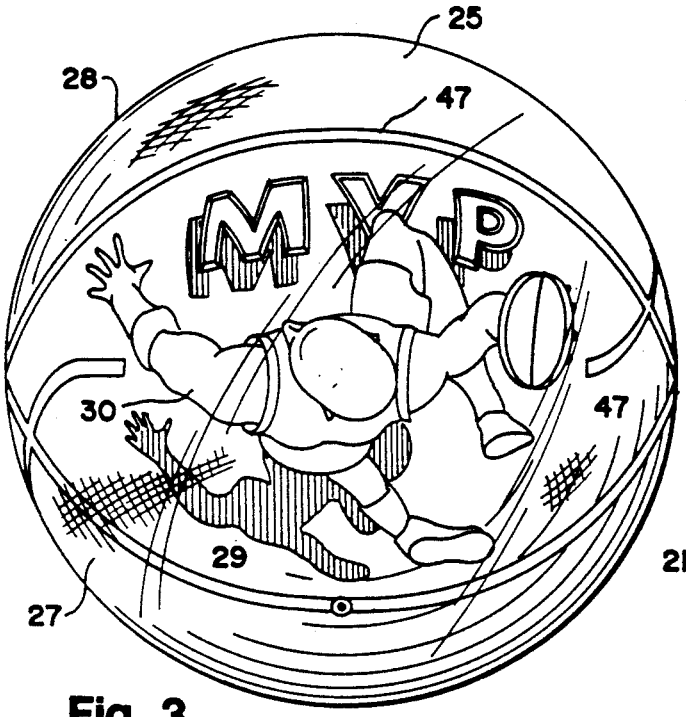
Fig. 3
Fig. 1 PRIOR ART
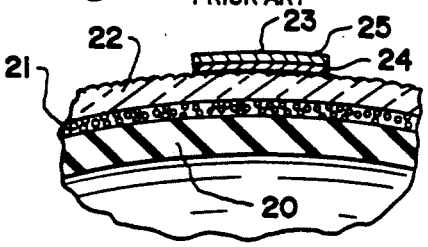
Fig. 2 PRIOR ART
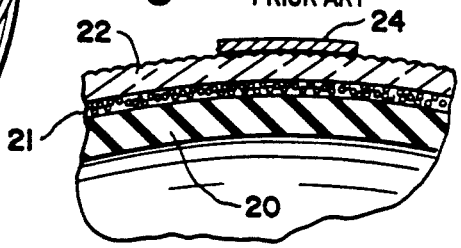
Fig. 4
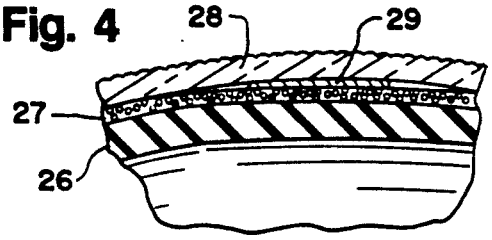
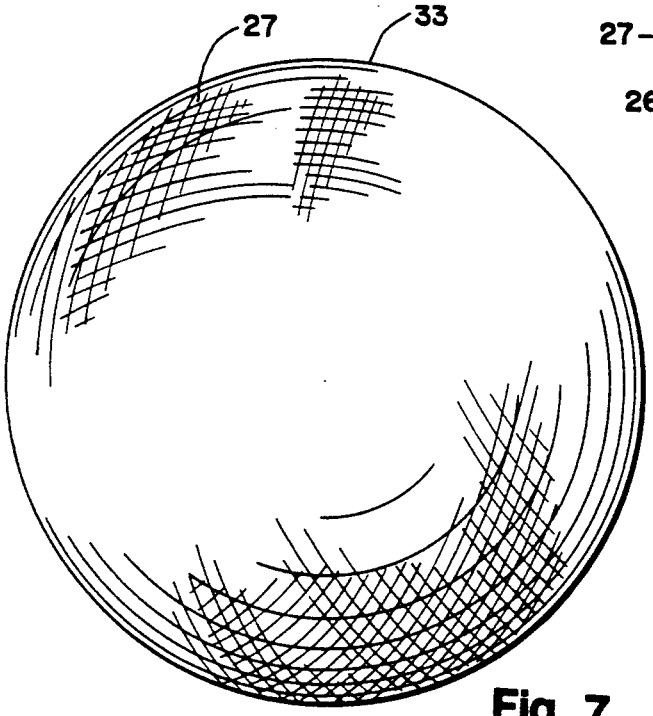
Fig. 7
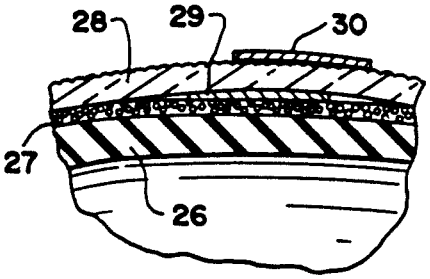
Fig. 5

Fig. 8
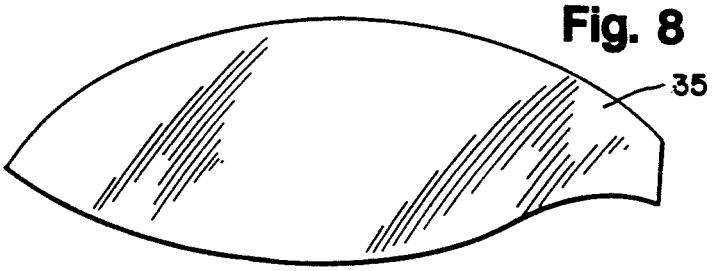
Fig. 10
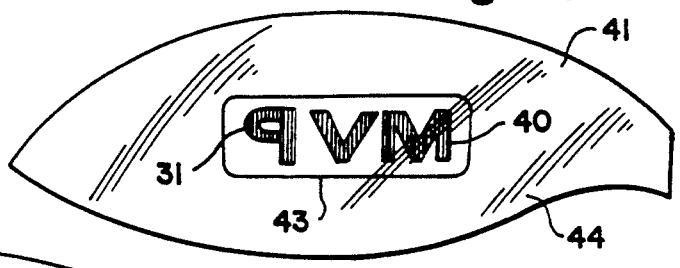
Fig. 9
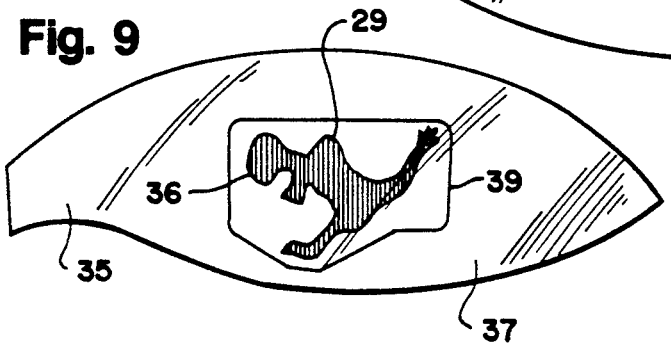
Fig. 13
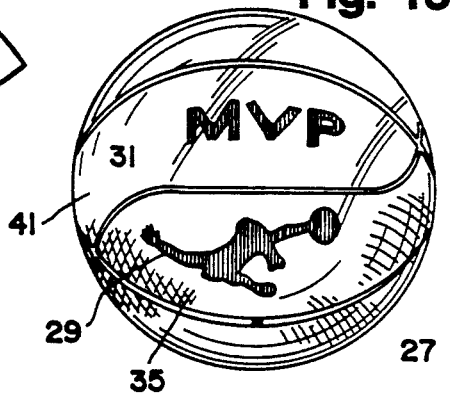
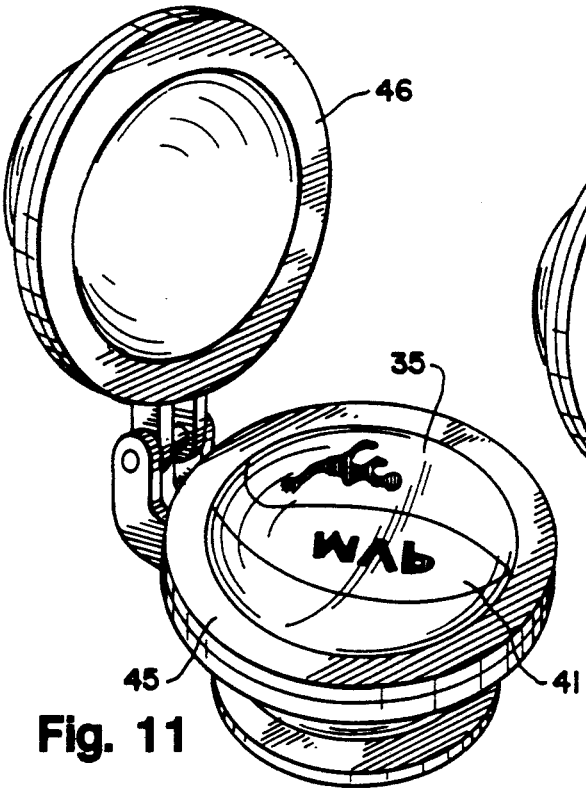
Fig. 11
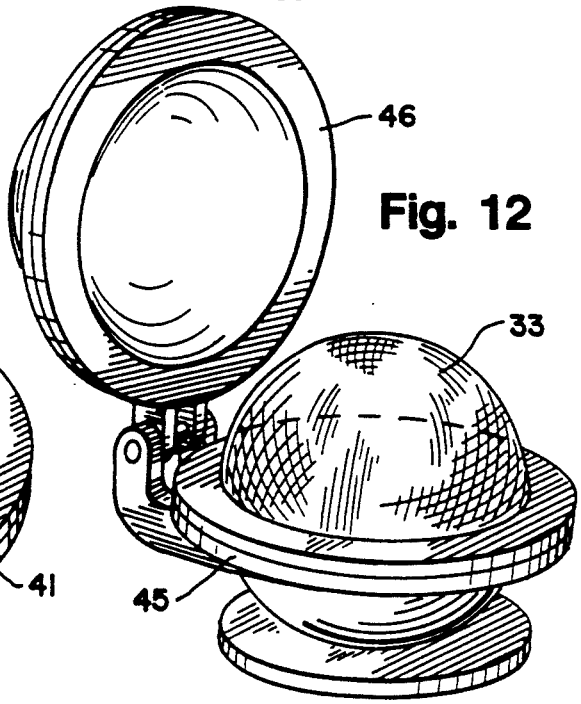
Fig. 12

GAME BALL WITH TRANSPARENT COVER

BACKGROUND

This invention relates to game balls, for example, basketballs, volleyballs, soccer balls, footballs, baseballs, and softballs. More particularly, the invention relates to a game ball with a transparent cover.

Game balls such as basketballs and footballs conventionally include an inflatable bladder and a cover made from leather or synthetic material. Other game balls such as softballs or baseballs include a core and a cover. Labels or decals may be applied to the outer surface of the ball to provide a logo, trademark, pictoral design, or the like. However, the label is exposed and is subject to wear or abrasion as the ball is used. The label may eventually fade, wear off, or become unsightly.

SUMMARY OF THE INVENTION

The invention provides a game ball with a transparent cover. The bladder or core of the ball is visible through the transparent cover to provide an unusual visual effect. A label can be positioned between the bladder or core and the cover, and the label is visible through the cover. However, the label is protected from wear and abrasion by the cover. A conventional outer label can be applied to the outer surface of the cover, and the spacing between the inner and outer layers which is provided by the cover provides a three-dimensional visual effect. The inner and outer layers can have substantially the same contour or outline and be slightly offset from a superimposed position to provide a shadow effect. The preferred cover material is EPDM and is vulcanized or cured by a peroxide vulcanizing agent.

DESCRIPTION OF THE DRAWINGS

The invention will be explained in conjunction with an illustrative embodiment shown in the accompanying drawing, in which FIG. 1 is a fragmentary cross sectional view of a prior art basketball showing a transfer decal being applied to the cover of the ball;

FIG. 2 is a view similar to FIG. 1 after the carrier sheet of the decal is removed;

FIG. 3 illustrates a basketball formed in accordance with the invention;

FIG. 4 is an enlarged fragmentary sectional view of the basketball of FIG. 3 before the outer labels are applied;

FIG. 5 is a view similar to FIG. 4 showing one of the outer labels;

FIG. 7 illustrates the wound bladder before the cover is applied;

FIG. 8 is a plan view of one of the panels of the cover;

FIG. 9 is a plan view of the panel of FIG. 8 with one of the inner labels applied to the inside surface of the panel;

FIG. 10 is a view of one of the panels of the cover showing another inner label applied to the inside surface of the panel;

FIG. 11 is a perspective view showing the panels of the cover being applied to the surface of a spherical two-part mold;

FIG. 12 is a view similar to FIG. 11 showing the wound bladder inserted in the mold; and FIG. 13 illustrates the basketball after the transparent cover is pre-molded onto the wound bladder.

DESCRIPTION OF SPECIFIC EMBODIMENT

Figure 6:
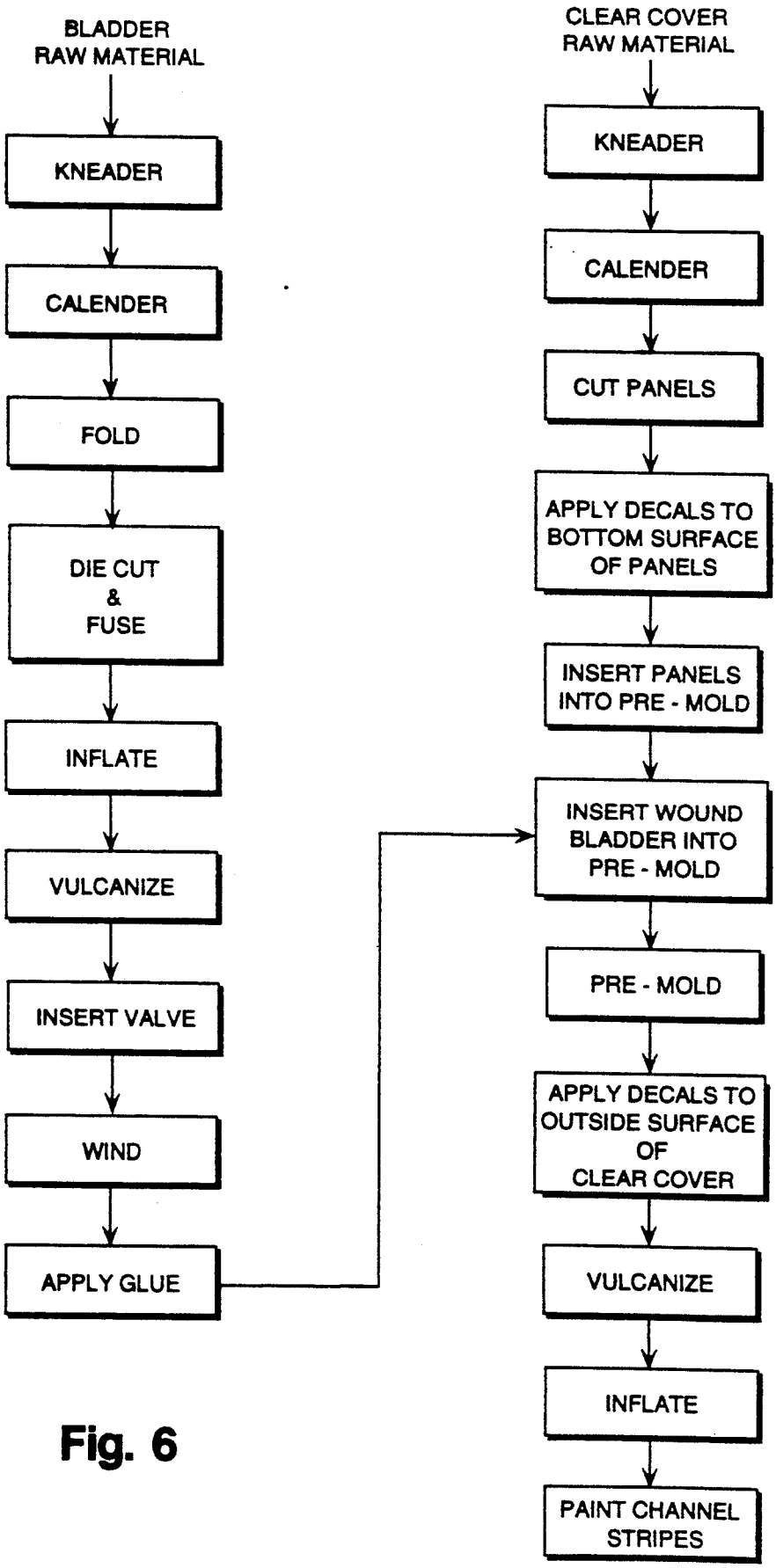
FIG. 6 is a schematic diagram of the process for manufacturing the basketball.

FIGS. 1 and 2 are cross sectional views of a conventional prior art game ball such as a basketball. An inflatable rubber bladder 20 is covered with a layer 21 of windings. The layer of windings may be formed from nylon, polyester or combination of nylon and polyester thread which is dipped or coated with in latex adhesive or other bonding agents and then wrapped around the bladder to cover the bladder. The layer of windings reinforces the bladder.

A rubber cover 22 is applied over the wound bladder. The cover of a basketball is conventionally formed from a plurality of panels which are applied over the outer surface of the wound bladder and molded onto the bladder. Conventional rubber covers may be formed from butadiene rubber or natural rubber with a filler such as calcium carbonate or clay and sulfur as the vulcanizing agent.

A transfer decal or label 23 can be applied to the outer surface of the cover to provide a logo, trademark, pictoral image, or the like. Conventional labels or decals include an image layer 24 formed from neoprene rubber which is applied to a polyester carrier film 25. After the label is applied to the cover, the cover is vulcanized or cured by placing the inflated ball into a two-part spherical mold and heating the mold. During vulcanization the image layer of the label bonds to the cover, and the polyester carrier film 25 is peeled off after the ball is removed from the mold. Labels or images can be applied in other ways to the outer surface, for example by foil embossing, painting, or screen printing.

A football conventionally includes an unwound rubber bladder and a cover which is made from leather or synthetic material. The cover is made from panels which are sewn together with the inner surfaces of the panels facing outwardly so that the cover is sewn in an inverted or inside-out position. A portion of the seam between two panels is left unsewn to provide an opening to insert the bladder. The cover is turned inside-in by inverting the cover through the opening, the bladder is inserted, and the opening is closed by lacing. Labels or decals can be applied to the outer surface of the cover.

A baseball or softball conventionally includes a core, a layer of windings over the core, and a cover of leather or synthetic material. Some balls omit the windings. The core can be cork, kapok, molded plastic, etc. The cover is conventionally formed from two dumbbell-shaped pieces which are stitched together over the core. Labels or decals can be applied to the outer surface of the cover.

In each of the foregoing game balls, the cover is opaque or non-transparent, and the bladder or core is not visible through the cover. Any label on the outside surface of the cover is exposed and is subject to wear and abrasion as the ball is used.

FIGS. 3–5 illustrate a game ball 25 which is formed in accordance with the invention. The particular ball illustrated is a basketball, but the invention can also be used with other balls such as volleyballs, soccer balls, footballs, baseballs, softballs, etc.

The ball 25 includes an inflatable rubber bladder 26, a layer 27 of windings, and a transparent or clear cover 28. The layer of windings may be formed by nylon, polyester, or a combination of nylon and polyester thread which is either coated or uncoated with adhesive. The preferred embodiment uses uncoated nylon and polyester thread. The completed windings are coated with a transparent or clear glue which will bond with the cover.

Before the cover 28 is applied to the wound bladder, a label or decal 29 is applied to the inside surface of the cover. The label 29 is advantageously formed by printing or painting an image in neoprene ink on a transparent synthetic rubber or polyethylene carrier film which will melt and bond to the core during the subsequent vulcanization or curing step. The label is visible through the transparent cover and is protected from wear and abrasion by the cover. The appearance of the label will remain unchanged throughout the life of the cover.

The windings 27 of the bladder are also visible through the transparent cover to provide a striking and unusual visual appearance. If the transparent cover is used on a ball which has an unwound bladder or a core, the bladder or core will be visible.

The preferred cover material is EPDM (ethylene-propylene rubber which includes a diene comonomer) such as Nordel hydrocarbon rubber from E.I. Du Pont de Nemours & Co. or Vistalon EPDM rubber from Exxon. The EPDM material is strengthened or reinforced with a filler such as Hi-Sil from PPG Industries, and EVA (ethylene vinyl acetate), for example, Escorere from Exxon, may be added to improve strength and transparency. The EPDM is vulcanized with a peroxide vulcanizing agent rather than a sulfur vulcanizing agent because sulfur-cured EPDM may not remain transparent. The preferred peroxide curing agent is Perkadox from Akzo. The cover may also include a coupling agent such as Silane from Union Carbide for coupling the EPDM and the EVA and a vulcanizing co-agent such as Rhenofit from Rhein Chemie.

Referring to FIG. 5, a conventional outer label or decal 30 may be applied to the outer surface of the cover 28. The outer label may be of the same type as the label 23 illustrated in FIG. 1 which includes an image layer which is carried by a carrier sheet. The carrier sheet is removed after the cover is vulcanized. Since the outer label is exposed, it is subject to wear in the same way as labels on conventional balls.

Unusual visual effects may be obtained by offsetting the inner and outer labels 29 and 30 slightly from a superimposed position to provide a three-dimensional appearance and/or a shadow effect. In FIG. 5 the image 29 of, for example, a basketball player is provided by the inner label on the inside surface of the cover, and the image 30 of a basketball player is provided by the outer label on the outside surface of the cover. A shadow effect can be obtained by using a black inner image and outer image which is colored or has some color other than black in order to provide maximum differentiation between the two images. The two images are separated by the thickness of the cover so that they have a three-dimensional appearance. The two images also have the same or substantially the same shape or contour, and the inner image 29 appears as the shadow of the outer image 30. In the particular embodiment illustrated, the shadow image 29 is somewhat smaller than the upper image 30 but has the same shape or contour.

Other designs or indicia, for example the letters MVP, can also be provided by inner and outer labels 31 and 32. The inner letters are on the inside surface of the cover, and, in the embodiment illustrated, are black. The outer letters are colored or are a color other than black. The inner and outer letters provide a three-dimensional, shadow appearance.

The procedure for manufacturing the basketball is illustrated schematically in FIG. 6. Raw material for making the bladder is fed into a kneader or a Banbury mixer. The raw materials in conventional basketball bladder material are primarily rubber. Material from the kneader is calendered into sheet stock. The sheet stock may be slightly thicker than conventional basketball bladder sheet because the EPDM cover is lighter than a rubber cover. The total weight of a game ball is normally specified by governing organizations for particular sports.

The sheet material is accordion-folded along both sides in the conventional manner, and a bladder is die-formed from the folded sheet by an oval-shaped die. The edges of the oval-shaped piece are fused to provide an air-tight, folded bladder. The bladder is inflated and placed in a heated vulcanizing mold where the rubber is vulcanized or cured. After vulcanizing, an inflating valve is inserted in the bladder.

Up to this point the manufacturing process for the bladder is conventional. However, rather than winding the bladder with nylon or polyester thread which is coated with latex glue or other bonding agents, the bladder is wound with uncoated nylon/polyester thread. The completed windings are coated with a clear or transparent glue which will bond or crosslink with the EPDM cover The wound bladder 33 is illustrated in FIG. 7.

The preferred composition of the glue which covers the windings is set forth in Table 1.

TABLE 1

| Ingredient | Parts by Weight |
|---|---|
| DuPont Nordel EPDM | 26.31 |
| Exxon Vistalone EPDM | 26.31 |
| White carbon (Silica) | 23.22 |
| Exxon Escorene EVA | 7.74 |
| Union Carbide Silane | 0.70 |
| Low temperature peroxide vulcanizing agent | 0.97 |
| High temperature peroxide vulcanizing agent | 1.21 |
| Vulcanizing co-agent | 1.16 |
| Tackifier resin | 12.38 |
| Total | 100.00 |

The preferred composition of the raw material for the transparent cover is set forth in Table 2.

TABLE 2

| Ingredient | Parts by Weight |
|---|---|
| DuPont EPDM | 28.67 |
| Exxon EPDM | 28.68 |
| White carbon (Silica) | 25.30 |
| Exxon Escorene EVA | 8.43 |
| Antioxidant | 1.15 |
| Union Carbide Silane | 0.76 |
| Akzo Perkadox low temperature vulcanizing agent | 2.38 |
| Rhein Chemie Rhenofit vulcanizing co-agent | 1.26 |
| Process oil | 3.37 |
| Total | 100.00 |

Referring to FIG. 6, the raw material is fed into the kneader or Banbury mixer and then into the calender for providing sheet material of a thickness of about 0.035 inch (0.9 mm). A release powder, for example, zinc oxide, can be added to the material in the calender to facilitate processing.

After the material is calendered into sheets, a plurality of panels 35 (FIG. 8) are die cut from the sheet. The cover of a typical basketball might include eight panels, and each panel is shaped so that the panels can be butted together over the bladder to completely cover the bladder.

Referring to FIG. 9, a label or decal 36 is applied to the surface 37 of the panel which will face toward the bladder and become the inside surface of the panel. The label 36 includes the image 29 (see FIG. 3) which is printed on a transparent carrier film 39. The label is secured to the panel by a solvent, for example, toluene with a clear resin which is applied to the label. The transparent carrier film 39 is preferably synthetic rubber film or polyethylene which will bond to the material of the panel during the subsequent vulcanization step. Since the image 29 is applied to the surface 37 of the panel which will become the inside surface when the panel is applied over the bladder, the image appears reversed in FIG. 9. The edge of the carrier film 39 is indicated in FIG. 9 for clarity of illustration, but the carrier film is transparent and is not visible through the panel 35.

FIG. 10 illustrates applying a label 40 to a panel 41. The label 40 includes the image 31 (see FIG. 3) of the letters MVP on a transparent carrier film 43. Since the label is applied to the surface 44 of the panel which will become the inside surface of the panel when the panel is applied to the bladder, the letters MVP appear reversed in FIG. 10.

FIG. 11 illustrates the panels 35 and 41 positioned on the inside concave surface of a conventional two-part spherical pre-mold having a bottom half 45 and a top half 46. The parts of the mold are provided with vacuum holes, and each of the panels are held in place by vacuum suction. The remaining panels which form the cover are also applied to the inside surface of the top and bottom mold parts.

FIG. 12 shows the wound bladder 33 inserted into the bottom half of the two-part pre-mold after the cover panels are positioned in the mold. The top half of the mold is closed over the bladder, and the bladder is inflated to a pressure of about 75 to 100 psi. FIG. 13 illustrates the ball after it is removed from the pre-mold.

After pre-molding, the outer labels 30 and 32 are applied to the outside surface of the cover, and the ball is placed in a two-part vulcanizing mold which is heated to a temperature of about 160° C. for about 4.5 minutes while internal pressure of about 100 psi is maintained in the bladder. During vulcanization the peroxide vulcanizing agent vulcanizes or cures the EPDM panels, the transparent glue which covers the windings on the bladder bonds or crosslinks with the EPDM panels, the carrier film of the inner labels bonds to the inside surface of the cover, and the images of the outer labels bond to the outside surface of the cover.

FIG. 3 illustrates the ball after it is removed from the vulcanizing mold. The inside surface of the mold is formed with embossments which form channels or grooves 47 in the cover where the edges of adjacent panels meet, and the edges of the panels are fused and bonded together. The mold can also apply a conventional pebbled or textured surface on the cover. The images 29 and 31 and the windings 27 are clearly visible through the transparent cover. The thickness of the transparent cover is about 1.62 to 1.76 mm, whereas the thickness of a conventional basketball cover is about 1.55 to 1.65 mm. The outer labels 30 and 32 are bonded to the outside surface of the cover. As previously described, the outer labels can be conventional transfer decals which include an image printed on a polyester carrier film. After vulcanization, the carrier film of the outer labels is peeled off.

After vulcanization, the ball is inflated to the desired pressure, and the channels 47 are painted. The outer label 30 may be applied across one of the channels, and that portion of the channel is left unpainted.

Conventional basketball covers have included minor amounts of EPDM as processing aids. However, this is the first basketball in which the major rubber component of the cover is EPDM. EPDM not only provides the desired transparency, but it also has good tackiness which facilitates gripping the ball.

Although we have described the inner and outer labels as including images printed on carrier sheets, other labels can be used. For example, both the inner and outer labels can be painted, printed, or silkscreened onto the inner and outer surfaces of the cover panels. Also, the inner images do not have to be black, and colored images can be applied to the inside of the cover. Alternatively, the inner images could be applied to the outside of the bladder or core of a ball rather than to the inside of the cover. If it is desired to have only a portion of the cover be transparent, then one or more transparent panels can be used with opaque panels.

The invention can be used with both wound and unwound bladders, and the term "bladder" as used in the claims is meant to include both. If the bladder is wound, then the wound surface of the bladder will be visible through the transparent cover. If the bladder is unwound, the unwound surface of the bladder will b visible.

While in the foregoing specification, a detailed description of specific embodiments of the invention have been set forth for the purpose of illustration, it will be understood that many of the details herein given may be varied considerably by those skilled in the art without departing from the spirit and scope of the invention.

We claim:

1. A game ball comprising:

an inflatable bladder, a layer of windings over the bladder, a transparent cover over the windings whereby the windings are visible through the transparent cover, an inner layer between the cover and the windings which is visible through the transparent cover, and an outer layer on the outside surface of the cover, each of the inner and outer labels comprising an image, the inner and outer images having substantially the same shape and being offset slightly from a superimposed position whereby the inner and outer images provide a three-dimensional visual effect.

2. The ball of claim 1 in which the inner image provides a shadow of the outer image.

3. The ball of claim 1 in which the game ball is a basketball.

4. A game ball comprising:

a core, a transparent cover over the core whereby the core is visible through the transparent cover, an inner label between the cover and the core which is visible through the transparent cover, and an outer label on the outside surface of the cover, each of the inner and outer labels comprising an image, the inner and outer images having substantially the same shape and being offset slightly from a superimposed position whereby the inner and outer images provide a three-dimensional visual effect.

5. The ball of claim 4 in which the inner image provides a shadow of the outer image.

6. The ball of claim 4 in which the game ball is a softball.

7. The ball of claim 4 in which the game ball is a baseball.

8. The ball of claim 4 in which the cover is formed from EPDM.

9. The ball of claim 8 in which the cover includes a peroxide vulcanizing agent.

* * * * *

UNITED STATES PATENT AND TRADEMARK OFFICE

CERTIFICATE OF CORRECTION

PATENT NO. : 5,320,345

DATED : June 14, 1994

INVENTOR(S) : Houang-Pin Lai et al

It is certified that error appears in the above-indentified patent and that said Letters Patent is hereby corrected as shown below:

Col. 6, line 54 change "layer" to —label—.

Signed and Sealed this

Sixth Day of December, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,320,345

DATED : June 14, 1994

INVENTOR(S) : Houang-Pin Lai et al

It is certified that error appears in the above-indentified patent and that said Letters Patent is hereby corrected as shown below:

Col. 6, line 56 change "layer" to --label--.

Signed and Sealed this

Thirtieth Day of May, 1995

Bruce Lehman

*Attest:*

BRUCE LEHMAN

*Attesting Officer*

*Commissioner of Patents and Trademarks*